252-99 AU 157 FX
8/7/84 XR 4,464,281

United States Patent [19]

Rapisarda et al.

[11] Patent Number: 4,464,281

[45] Date of Patent: Aug. 7, 1984

[54] STABILIZED BLEACH-SENSITIVE DYES IN AUTOMATIC DISHWASHER DETERGENT COMPOSITIONS

[75] Inventors: Anthony Rapisarda, Elmhurst, N.Y.; Edilia Camps, Elizabeth; Herbert Bauer, Saddle Brook, both of N.J.

[73] Assignee: Lever Brothers Company, New York, N.Y.

[21] Appl. No.: 518,248

[22] Filed: Jul. 28, 1983

[51] Int. Cl.[3] ..... C11D 7/54; C11D 7/56; C11D 7/12; C11D 17/06

[52] U.S. Cl. ..... 252/174.21; 252/99; 252/102

[58] Field of Search ..... 252/99, 102, 174.21

[56] References Cited

U.S. PATENT DOCUMENTS

| | | | |
|---|---|---|---|
| 2,502,881 | 4/1950 | Parker | 252/109 |
| 3,112,274 | 11/1959 | Morgenthaler et al. | 252/102 |
| 3,598,743 | 8/1971 | Coates | 252/99 |
| 3,609,088 | 9/1971 | Sumner | 252/99 |
| 3,630,923 | 12/1971 | Simmons et al. | 252/99 |
| 3,761,416 | 9/1973 | Stahlheber | 252/99 |
| 3,945,937 | 3/1976 | Villaume | 252/99 |
| 3,956,401 | 5/1976 | Scardera et al. | 260/615 B |
| 4,237,024 | 12/1980 | Fedechko | 252/99 |
| 4,309,299 | 1/1982 | Rapisarda et al. | 252/99 |
| 4,324,677 | 4/1982 | Kaufmann et al. | 252/99 |
| 4,379,069 | 4/1983 | Rapisarda et al. | 252/135 |

FOREIGN PATENT DOCUMENTS

| | | | |
|---|---|---|---|
| 712126 | 6/1965 | Canada | 252/99 |

*Primary Examiner*—John E. Kittle
*Assistant Examiner*—Mukund J. Shah
*Attorney, Agent, or Firm*—Milton L. Honig; James J. Farrell

[57] ABSTRACT

A method for stabilizing automatic dishwasher detergents containing bleach-sensitive dyes against decolorization by the bleaching agents of the compositions. The detergent powders comprise about 5–70% of a builder, 1–15% of a nonionic surfactant, 1–20% of a silicate, 0–60% of a filler, 0.001–0.1% of a bleach-sensitive dye, water and a bleaching agent. Prior to the addition of bleaching agent, the composition is pre-conditioned by contact with a flow of air. The resultant powder has a color that remains essentially unchanged even after storage for two months at elevated temperatures.

30 Claims, No Drawings

STABILIZED BLEACH-SENSITIVE DYES IN AUTOMATIC DISHWASHER DETERGENT COMPOSITIONS

BACKGROUND OF THE INVENTION

1. Field of the Invention

The invention relates to a composition and method for preparing an automatic dishwasher detergent containing nonstaining bleach-sensitive dyes stabilized against decomposition from bleaching agents contained within the detergent formulation.

2. The Prior Art

Automatic dishwasher detergents are colored for identification. Confusion must be avoided between these detergents and other white granular products used in the kitchen. Avoidance of such confusion is desirable because dishwasher detergents necessarily are alkaline and contain a chlorine bleach. These components are hazardous when improperly used. They should not resemble such kitchen powders as sugar, salt, corn starch and other white granulates.

Yellow is a particularly attractive color. Several liquid dishwashing products on the market now contain lemon juice for extra cleaning power. Similarly, certain detergent powders contain a lemon scent. Lemon perfume pleasantly exudes from these powders. It would be incongruous, if not disappointing to the consumer, to color these powders other than yellow.

Those dishwasher detergents not marketed with a lemon theme frequently employ colors other than yellow. For instance, green is a particularly prevalent commercial color for these products.

While a wide choice of colorants is available for coloring the formulations, they are not all equally suitable. Generally, pigments are preferred because of their stability towards activated bleach, bleach being an important component in dishwasher detergents. Pigments suffer from one major disadvantage. They cause severe staining of plastic dishwasher parts and plastic tableware. In fact, for purposes of this disclosure, pigments are defined as plastic staining organic or inorganic chemicals. Illustrative of yellow colorants which stain are pigment Yellow Numbers 1, 3, and 49 identified by their Color Index (C.I.) numbers 11680, 11710 and 11765, respectively, and Yellow pigment 155. Colorants encompassed by this invention are herein defined as dyes. They are non-staining organic chemicals. They are almost always water-soluble for easy removal from substrates. However, there are some operative colorants suitable as dyes that may not be appreciably water-soluble Staining can be overcome where special techniques are used to incorporate the pigment into the dishwasher formulation. For example, U.S. Pat. No. 3,544,473 to Kitchen et al teaches that insoluble phthalocyanine green causes severe staining when it is used with nonionic surfactants of the condensed propylene oxideethylene oxide variety. By utilizing a particular nonionic, a $C_{13}$–$C_{21}$ fatty alcohol ethoxylated with 5–12 moles ethylene oxide, staining was eliminated.

Soluble dyes can be readily incorporated into dishwasher detergent formulations. They are preferable to pigments. They do not stain. Unlike the pigments, however, soluble dyes are frequently bleach-sensitive. For instance, chlorine from the chlorinating agent of a formulation may adversely interact with the dye. This causes color to fade or sometimes completely disappear.

It is an object of the present invention to provide a color stable automatic dishwasher detergent containing a bleaching agent and a bleach-sensitive dye.

It is a further object of this invention to present a method for obtaining color stable automatic dishwasher detergents containing a bleaching agent and a bleach-sensitive dye.

SUMMARY OF THE INVENTION

An automatic dishwasher detergent powder is disclosed comprising:

(a) from about 5% to about 70% of a builder;
(b) from about 1% to about 15% of a nonionic surfactant;
(c) from about 1% to about 20% of a silicate;
(d) from about 0% to about 60% of a filler;
I(e) from about 0.001% to about 0.1% of a bleach-sensitive dye; and
(f) water;

wherein the composition is pre-conditioned by contact with a flow of air prior to the addition of a bleaching agent, in an effective amount to clean dishes, affording a resultant powder whose color remains essentially unchanged even after storage for two months at elevated temperatures.

A method for preparing an automatic dishwasher detergent powder is disclosed comprising:

(i) combining into one mixture
  (a) from about 5% to about 70% of a builder;
  (b) from about 1% to about 15% of a nonionic surfactant;
  (c) from about 1% to about 20% of a silicate;
  (d) from about 0% to about 60% of a filler;
  (e) from about 0.001% to about 0.1% of a bleach-sensitive dye; and
  (f) water;
( ii) pre-conditioning the mixture by contact with a flow of air; and
(iii) dosing the pre-conditioned mixture with a bleaching agent in an effective amount to clean dishes;

the resultant powder having a color that remains essentially unchanged even after storage for two months at elevated temperatures.

DETAILED DESCRIPTION OF THE INVENTION

It has been found that color stable bleach containing dishwasher detergents can be prepared by conditioning the composition prior to addition of the bleaching agent. The critical step is herein referred to as "pre-conditioning". Preconditioning involves contacting the bleach-free composition with a flow of air. The air temperature may range from ambient up to about 100° C. Hotter air, within the aforementioned range, has been found to be more efficient. Contact times may be shortened as the air flow and its temperature increases.

Air temperatures may be varied during the process. For instance, where a fluidized bed system is utilized, it is preferred that hot air (40°–85° C.) is first passed through the bleach-free composition. Thereafter, cooler air is forced through the composition.

Powder agitation is another factor that influences preconditioning. The more thorough the agitation the faster the rate.

Although the color stable dishwasher detergent of this invention can be prepared in a variety of ways, there are two preferred continuous process routes for manufacture of an agglomerated product. One route involves mixing sodium tripolyphosphate and soda ash followed by spraying with nonionic and water in a blending vessel. Subsequent to blending, the components are fed and agitated in a conditioner-hydrator apparatus. After about twenty minutes, the blend is charged to a second blending vessel. More soda ash, aqueous sodium silicate, sodium sulfate and an aqueous dye solution are added simultaneously. Pre-conditioning of the resultant powder is performed in a two-zone fluid bed reactor. Air at 65°-70° C. is forced through the product over a 10 to 20 minute interval. Air at a lower temperature is then directed at the product in a second zone. After particle size screening, the bleaching agent is combined by mixing with the powder.

Another preferred continuous process involves addition of sodium tripolyphosphate, soda ash and sodium sulfate to a rolling drum agglomerator. Both an aqueous silicate/dye mixture and a nonionic surfactant stream are sprayed into the rotating drum fitted with suitable powder agitation means. Examples of suitable agitation means commonly used in the industry are described in U.S. Pat. No. 3,609,088, herein incorporated by reference. After about 30 minutes, the resultant powder is fed into a revolving conditioner vessel to accomplish preconditioning. Heated air is blown through the conditioner vessel. Ambient temperature air can also accomplish the conditioning but requires a longer reaction time. Thereafter, the powder is sent through a particle size screener into a final mixing vessel where bleaching agent is added.

A preferred batch process involves charging a batch agglomerator vessel with a mixture of sodium sulfate and tripolyphosphate, spraying said mixture with a combined aqueous dye solution and nonionic surfactant. Thereupon sodium carbonate and a solid hydrous sodium silicate are added followed by thorough blending and the addition of a final aqueous dye spray to complete coloration. After another thorough blending, the resultant powder particles are size screened. They are then fed to a fluid bed for pre-conditioning treatment with an air flow. A mixing chamber receives the preconditioned powder where bleaching agent is dosed to the product.

A typical detergent composition indicating the ingredients and their relative proportions employed according to the present invention, is set forth in Table 1.

TABLE 1

Components of the Stabilized, Bleach-Sensitive Dye Automatic Dishwasher Detergent

| Component | Percent by Weight | |
|---|---|---|
| | Range | Preferred Concentration |
| Builder | 5-70 | 15-40 |
| Nonionic Surfactant | 1-15 | 2-8 |
| Silicate | 1-20 | 5-15 |
| Filler | 0-60 | 8-20 |
| Bleach-Sensitive Dye | 0.001-0.1 | 0.01-0.06 |
| Bleaching Agent | 0.1-20 | 1-15 |
| Water | till 100 | till 100 |

To evaluate color fastness of the final powder, a rating code was utilized. It is outlined in Table 2. Powders of varying shades of yellow were visually assigned an arbitrary rating from 1 to 4 depending on color intensity. Higher values signify greater degrees of fading. For reference purposes, a colorant bearing detergent powder but without bleach was assigned a perfect score of 1. Color rating 4, severe fading, was referenced with an almost white totally bleached powder. Thus, for example, the gradations of deep lemon yellow, lemon yellow, pale yellow and almost white would correspond to the ratings 1, 2, 3 and 4, respectively.

The rating scheme must be applied between samples of the same formulation. Identical colorants and concentrations are required.

TABLE 2

Color Rating Code

1=no fading (acceptable)
2=slight fading (acceptable)
3=moderate fading (borderline acceptable)
4=severe fading (unacceptable)

A second color evaluation method based on spectrophotometric reflectance measurements expressed in terms of absorbance was used to complement that of the rating code system. Values in % relative absorbance were derived from these spectrophotometric measurements. Powders with % relative absorbances over 50% were considered acceptable.

The % relative absorbance was determined in the following manner. A sample powder, fully formulated except for bleaching agent, was spectrophotometrically measured as a reference. A single wavelength in the 400-500 nm (yellow) range was selected as the measurement peak. For D&C Yellow 10 and Acid Yellow 17, the wavelengths selected were 430 and 410 nm, respectively. The absorbance of the reference sample was assigned arbitrally as the maximum absorbance (100%). Detergent samples of the same formula but with bleaching agent were then spectrophotometrically evaluated. The ratio of sample to reference absorbance multiplied by 100 afforded the % relative absorbance. Error limits in the % relative absorbance were approximately ±10%. The highly segregated non-homogeneous nature of the color detergent particles was the major contributor to this error.

Detergent Builder Materials

The dishwashing detergents of this invention can contain all manner of detergent builders commonly taught for use in automatic dishwashing compositions. The builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, sesquicarbonate and borate.

Particularly preferred builders can be selected from the group consisting of sodium tripolyphosphate, sodium carbonate, sodium bicarbonate and mixtures thereof. When present in these compositions, sodium tripolyphosphate concentrations will range from about 10% to about 40%; preferably from about 25% to about 40%. Sodium carbonate and bicarbonate when present can range from about 10% to about 50%; preferably from about 20% to about 40%.

Organic detergent builders can also be used in the present invention. They are generally sodium and potassium salts of the following: citrate, nitrilotriacetates, phytates, polyphosphonates, oxydisuccinates, oxydiacetates, carboxymethyloxy succinates, tetracarboxylates, starch and oxidized heteropolymeric polysaccharides.

Sodium citrate is an especially preferred builder. When present it is preferably available from about 1% to about 35% of the total weight of the detergent composition.

The foregoing detergent builders are meant to illustrate but not limit the types of builder that can be employed in the present invention.

Nonionic Surfactants

Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types as suitable nonionic surfactants include:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 6 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particulary preferred nonionic surfactant compounds in this category are the "Neodol" type products, a registered trademark of the Shell Chemical Company.

Included within this category are nonionic surfactants having the formula:

$$RO-(CH_2\underset{\underset{R'}{|}}{C}HO)_x(CH_2CH_2O)_y(CH_2\underset{\underset{R''}{|}}{C}HO)_z-H$$

wherein R is a linear, alkyl hydrocarbon having an average of 6 to 10 carbon atoms, R′ and R″ are each linear alkyl hydrocarbons of about 1 to 4 carbon atoms, x is an integer from 1 to 6, y is an integer from 4 to 15 and z is an integer from 4 to 25. A particularly preferred example of this category is Poly-Tergent SLF-18, a registered trademark of the Olin Corporation, New Haven, Conn. Poly-Tergent SLF-18 has a composition of the above formula where R is a $C_6$–$C_{10}$ linear alkyl mixture, R′ and R″ are methyl, x averages 3, y averages 12 and z averages 16.

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di-, or tri-acid esters.

(e) polyoxyethylene-polyoxypropylene block polymers having the formula:

$$HO(CH_2CH_2O)_a(CH(CH_3)CH_2O)_b(CH_2CH_2O)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available under the trademark "Pluronics", a product of BASF-Wyandotte Corporation.

Bleaching Agent

A wide variety of bleaching agents may be employed for use with these detergent powders. Both halogen and peroxygen type bleaches are encompassed by this invention.

Among the suitable halogen donor bleaches are heterocyclic N-bromo and N-chloro imides such as trichlorocyanuric, tribromocyanuric, dibromo- and dichlorocyanuric acids, and salts thereof with water-solubilizing cations such as potassium and sodium. An example of the hydrated dichlorocyanuric acid is Clearon CDB56, a product manufactured by the FMC Corporation. Such bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66", indicating the parts per pound of available chlorine) which comprises a mixture of potassium dichloroisocyanurate (4 parts) and trichloroisocyanurate acid (1 part).

Other N-bromo and N-chloro imides may also be used such as N-brominated and N-chlorinated succinimide, malonimide, phthalimide and naphthalimide. Other compounds include the hydantoins, such as 1, 3-dibromo and 1,3-dichloro-5,5-dimethylhydantoin, N-monochloro-C,C-dimethylhydantoin methylene-bis(N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-isobutylhydantoin; 1,3-dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

The hypohalite liberating agent, may, if desired, be provided in a form of a stable solid complex or hydrate.

Examples include sodium p-toluene-sulfo-bromoamine-trihydrate, sodium benzene-sulfo-chloroamine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Preferred chlorinating agents include potassium and sodium dichloroisocyanurate dihydrate, chlorinated trisodium phosphate and calcium hypochlorite. Particularly preferred are sodium or potassium dichloroisocyanurate dihydrate. Preferred concentrations of all of these materials should be such that they provide about 0.2 to about 1.5% available chlorine.

Suitable chlorine-releasing agents are also disclosed in the ACS monograph entitled "Chlorine-Its Manufacture, Properties and Uses" by Sconce, published by Reinhold in 1962. This book is incorporated by reference.

Among the suitable peroxygen active bleaches are potassium, sodium and ammonium salts of persulfate, dipersulfate, peroxide and perborate. Organic peroxides such as lauroyl peroxide are also suitable.

Bleach-Sensitive Dye

Colorants which cause severe staining of plastic dishwasher parts or plastic tableware are undesirable for use with this invention. Pigments exhibit these undesirable properties. Colorants of the present invention are bleach-sensitive, non-staining dyes.

A wide variety of dyes may be used in dishwasher detergents of the instant invention. Colorants may be classified into groups according to their chemical structures. Suitable dyes may be chosen from the nitro, azo, triphenylmethane, xanthene (fluoran), quinoline, anthroquinone, indigoid and pyrene type colorants. Specific examples of these materials can be found in the article "Colorants For Foods, Drugs, and Cosmetics" by Zuckerman and Senackerib found in the *Kirk-Othmer Encyclopedia of Chemical Technology,* Volume 6, 3rd Edition, pages 561 to 596 and is incorporated by reference.

Yellow colorants are particularly preferred because of the dishwasher detergent powders marketed under the "lemon juice" concept. Consumers expect yellow products where lemon juice and/or lemon fragrance is incorporated within a product. Particularly preferred colorants for this purpose are FD&C and D&C Yellow Numbers 5 through 10, and External D&C Yellow No. 7. These materials are chemically identified in the table below.

| Official FDA Name and Trade name | Classification C.I. Name and Number | Chemical Name and CAS Registry Number |
|---|---|---|
| FD & C Yellow No. 5 (Tartrazine) | pyrazolone; CI Food Yellow 4, CI No. 19140 | trisodium salt of 4,5-dihydro-5-oxo-1-(4-sulfophenyl)-4-[(4-sulfophenyl)azo]-4H pyrazole-3-carboxylic acid [1934-21-0] |
| FD & C Yellow No. 6 (Sunset Yellow FCF) | monoazo; CI Food Yellow 5 CI No. 15985 | disodium salt of 6-hydroxy-5-[(4-sulfophenyl)azo]2-naphtha lene sulfonic acid [2783-94-0] |
| FD & C Yellow No. 7 (Fluorescein) | fluoran; CI Acid Yellow 73, CI No. 45350 | fluorescein [518-15-6] |
| FD & C Yellow No. 8 (Uranine) | xanthene; CI Acid Yellow 73 CI No. 45350 | disodium salt of fluorescein [518-47-8] |
| D & C Yellow No. 10 (Quinoline Yellow WS, Quinoline Yellow) | quinoline; CI Acid Yellow 3 CI No. 47005 | mono- and disodium salts of the 6-mono- and 6,5'-disulfonic acids of 2-(2-quinolinyl) 1,3-indandione [8004-92-0] and [38615-46-2], respectively |
| Ext D & C Yellow No. 7 (Naphthol Yellow S) | nitro; CI Acid Yellow 1, CI No. 10315 | disodium salt of 8-hydroxy-5,7-dinitro-2-naphthalenesulfonic acid [846-70-8] |
| Acid Yellow 17 | CI Food Yellow 5 CI No. 18965 | disodium salt of 2,5-dichloro-4-[5-hydroxy-3-methyl-4-(4-sulfophenylazo)-pyrazol-1-yl]benzenesulfonic acid [6359-98-4] |

A preferred dye is D&C Yellow No, 10, a quinoline derivative.

The most preferred colorant is Acid Yellow 17, monoazo dye. The compound is commercially available from Ciba-Geigy, Sandoz and Hilton-Davis Corporations under the trademarks Erio yellow 2g, Sandolan yellow E-2gL and Hidacid fast light yellow 2g, respectively.

Silicate

The compositions of this invention contain sodium or potassium silicate. This material is employed as a cleaning ingredient, source of alkalinity, metal corrosion inhibitor and protector of glaze on china tableware. Especially effective is sodium silicate having a ratio of $SiO_2O:Na_2O$ of from about 1.0 to about 3.3, preferably from about 2 to about 3.2. Some of the silicate may be in solid form.

Filler

An inert particulate filler material which is water-soluble may also be present. This material should not precipitate calcium or magnesium ions at the filler use level. Suitable for this purpose are organic or inorganic compounds. Organic fillers include sucrose, sucrose esters and urea. Representative inorganic fillers include sodium sulfate, sodium chloride and potassium chloride. A preferred filler is sodium sulfate. Its concentration may range from 0% to 60%, preferably about 10% to 20%.

Minor amounts of various other adjuvants may be present in the detergent powder. These include perfumes, flow control agents, foam depressants, soil suspending agents, antiredeposition agents, anti-tarnish agents, enzymes and other functional additives.

The following examples will more fully illustrate the embodiments of this invention. All parts, percentages and proportions referred to herein and in the appended claims are by weight unless otherwise indicated.

EXAMPLE I

Several automatic dishwasher detergent powders were prepared containing 6.1% phosphorus. Their composition and order of raw material addition are outlined in Table 3 below.

TABLE 3

6.1% P Formula - Composition and Raw Material Order of Addition

| Order of Addition | Component | | % Active |
|---|---|---|---|
| 1 | Sodium tripolyphosphate | | 24.00 |
| 2 | Sodium sulfate | | 15.16 |
| 3 | Premix of: | (a) Water | 5.63 |
| | | (b) Colorant: D & C Yellow 10 | 0.03 |
| | | (c) Pluronic L62 D | 2.25 |
| | | (d) Pluronic L61 | 0.75 |
| | | (e) Monostearyl acid phosphate | 0.09 |
| 4 | Sodium carbonate | | 35.00 |
| 5 | Hydrous sodium silicate (~82.5% solids, 2.4 $SiO_2$:$Na_2O$ ratio) | | 13.70 |
| 6 | Premix of: | (a) Water | 2.00 |
| | | (b) Colorant: D & C Yellow 10 | 0.03 |
| 7 | Perfume | | 0.20 |
| 8 | Sodium dichloroisocyanurate-dihydrate | | 1.16 |

Very light colored batches of material were obtained by direct combination of the eight components of Table 3. Eight batches of detergent were prepared according to the Table 3 formulation without a pre-conditioning step. Color stability was evaluated by both a visual rating and a spectrophotometric derived color value expressed in % Relative Absorbance. A direct correlation was obtained between the color ratings and absorbance methods. These results are shown in Table 4 below.

TABLE 4

6.1% P Formula - Evaluation of Light Colored Product

| Batch | Color Rating | Absorbance (430 nm) | % Relative Absorbance |
|---|---|---|---|
| 1 | 4 (severe fading) | 0.10 | 14.9 |
| 2 | 4 (severe fading) | 0.12 | 17.9 |
| 3 | 3 (moderate fading) | 0.33 | 49.3 |
| 4 | 3–4 (moderate to severe fading) | 0.26 | 38.8 |
| 5 | 4 (severe fading) | 0.15 | 22.4 |
| 6 | 3 (moderate fading) | 0.35 | 52.2 |

TABLE 4-continued 6.1% P Formula - Evaluation of Light Colored Product

| Batch | Color Rating | Absorbance (430 nm) | % Relative Absorbance |
|---|---|---|---|
| 7 | 3 (moderate fading) | 0.28 | 41.8 |
| 8 | 3–4 (moderate to severe fading) | 0.15 | 22.4 |

Absorbance values were measured with a double beam Perkin-Elmer 330 UV/VIS Recording Spectrophotometer. An "Intergrating Sphere" accessory was employed to sum the reflected absorbances. Integration helps minimize particle size effects. Sample powders were screened to achieve more uniform particle size. Only those particles passing a 10 mesh but held by a 35 mesh screen were utilized. These were charged to a jar cap of ½-depth by 2-inch diameter. Saran TM transparent film was wrapped around the cap to prevent egress of powder. A white barium sulfate plate, also wrapped in Saran TM film, served as a reference surface. Each analysis began with reference positioning of a barium sulphate plate in both sample beams to establish a baseline. Subsequently, the sample powder filled jar cap replaced one of the reference plates. The wavelength range from 800 to 400 nm was scanned in the reflectance mode for reflected absorbance (scan speed of 120 nm/minute). Several absorption peaks appeared within that range. A peak at 430 nm was selected for absorbance measurements with powders containing D&C Yellow 10. A reference sample, the Table 3 composition without sodium dichloroisocyanurate, exhibited an absorbance of 0.67 at 430 nm. To obtain % Relative Absorbance, for example, on batch 1, the absorbance of the fully formulated powder (0.10) was divided by that of the reference (0.67) and multiplied by 100 to obtain 14.9%. Other values were calculated similarly.

An identically composed formulation was prepared by the method used in obtaining batches 1 through 8 with one modification. Prior to the addition of sodium dichloroisocyanurate and perfume, ingredients 1 through 6 were pre-conditioned. It was accomplished in a fluidizer bed by blowing hot air (about 80° C.) for six minutes through the composition. Thereafter, cold air was blown through the composition for an additional four minutes. Product color was found to be acceptable. Color ratings are outlined in Table 5.

TABLE 5

6.1% P Formula - Evaluation of Product Made By Fluidization Pre-Conditioning

| Batch | Color Rating |
|---|---|
| 9 | 2 (slight fading) |
| 10 | 2–3 (slight to moderate fading) |

EXAMPLE II

Another series of products utilizing the compositions of Example I were prepared. These batches were preconditioned by fluidizing for 10 minutes at 80° C. Cool air was thereafter introduced for a period of four minutes. Chlorinating agent was then post-dosed to the composition. With the slightly longer hot air pre-conditioning, the products had improved color ratings. The results are outlined in Table 6.

TABLE 6

| 6.1% P Formula - Evaluation of Fluidized Pre-Conditioned Detergent Powder | | | |
|---|---|---|---|
| Batch | Color Rating | Absorbance at 430 nm | % Relative Absorbance |
| 11 | 1-2 (very slight fading) | 0.48 | 71.6 |
| 12 | 1 (no fading) | 0.45 | 67.2 |
| 13 | 1 (no fading) | 0.54 | 80.6 |
| 14 | 1 (no fading) | 0.47 | 70.1 |

Comparison of the data for the composition of Example I with and without pre-conditioning demonstrate the effectiveness of this added procedure. Where a product, colored with a bleach sensitive dye, is not sufficiently conditioned prior to adding a chlorinating agent, a high degree of color fading characterizes the finished product.

EXAMPLE III

Storage stability tests were conducted. These were used to demonstrate the necessity of pre-conditioning the detergent powder to obtain good color stability even when stored at high temperatures over long periods of time. Two batches of 6.1% P formula colored yellow with D&C Yellow 10 were prepared. Batch 16 was conditioned by fluidizing the composition of Example I, chlorinating agent being absent, for 10 minutes at 80° C. Cool air was then introduced over a five minute period at 20° C. Batch 15 was not conditioned at all.

Samples were stored for two months at room temperature, at 95° F. (50% relative humidity) and at the 125° F./90° F. cycle. Color ratings were then determined. After remaining in storage at room temperature for an additional six months, all the samples were measured for % Relative Absorbance. The results are outlined in Table 7. Unconditioned Batch 15, immediately after preparation, evidenced through the Color Rating of 1-2, the beginning of dye instability. Upon exposure to a 125° F./90° F. temperature cycle, color degradation become even more evident. After two weeks the rating declined to a 3, borderline acceptable. Within 2 months, fading was severe; the rating was 4, unacceptable. Batch 16, with conditioning, exhibited satisfactory color, rating of 1, throughout its evaluation. Relative Absorbance measurements confirm these results. Although generally in agreement, the Color Rating and % Relative Absorbance did, in certain instances, diverge slightly. The six month interval between these measurements and test scatter are believed responsible for any inconsistencies.

TABLE 7

| 6.1% P Formula - Comparison of Batches With and Without Conditioning | | | | | |
|---|---|---|---|---|---|
| | Initial | 1 Wk | 2 Wk | 1 Mo | 2 Mo |
| A. Batch 15 (without conditioning) | | | | | |
| Color Ratings | | | | | |
| RT | 1-2 | 1-2 | 1-2 | 1-2 | 1-2 |
| 95° F./50% RH | — | 1-2 | 1-2 | 1-2 | 2-3 |
| 125° F./90° F. | — | 1-2/2 | 3 | 3-4 | 4 |
| % Relative Absorbance (A at 430 nm) | | | | | |
| RT | — | — | — | — | 78.7 (0.48) |
| 95° F./50% RH | — | — | — | — | 54.1 (0.33) |
| 125° F./90° F. | — | — | — | — | 32.8 (0.20) |
| % Available Chlorine | | | | | |
| RT | 0.48 | 0.45 | 0.42 | 0.47 | 0.42 |
| 95° F./50% RH | — | 0.45 | 0.43 | 0.39 | 0.33 |
| 125° F./90° F. | — | 0.45 | 0.35 | 0.21 | 0.13 |
| B. Batch 16 (with conditioning) | | | | | |

TABLE 7-continued

| 6.1% P Formula - Comparison of Batches With and Without Conditioning | | | | | |
|---|---|---|---|---|---|
| | Initial | 1 Wk | 2 Wk | 1 Mo | 2 Mo |
| Color Ratings | | | | | |
| RT | 1 | 1 | 1 | 1 | 1 |
| 95° F./50% RH | — | 1 | 1 | 1 | 1 |
| 125° F./90° F. | — | 1 | 1 | 1 | 1 |
| % Relative Absorbance (A at 430 nm) | | | | | |
| RT | — | — | — | — | 80.3 (0.49) |
| 90° F./50% RH | — | — | — | — | 75.4 (0.46) |
| 125° F./90° F. | — | — | — | — | 59.0 (0.36) |
| % Available Chlorine | | | | | |
| RT | 0.58 | 0.65 | 0.57 | 0.55 | 0.57 |
| 90° F./50% RH | — | 0.52 | 0.51 | 0.52 | 0.48 |
| 125° F./90° F. | — | 0.52 | 0.52 | 0.49 | 0.44 |

EXAMPLE IV

Other bleach sensitive dyes have been examined. The same ingredients as in Example I, except for the dye, were incorporated into a set of formulations. Detergent powders having acceptable colors were obtained in all instances for those dyes shown in Table 8. Batches 17-19 were pre-conditioned for 15 minutes by blowing hot air (80° C.) through the composition of Example I prior to dosing with the chlorinating agent and perfume. Batches 20 and 21 were pre-conditioned for 15 minutes with air at 40° C. and at 35° C., respectively.

TABLE 8

| 6.1% P Formula - Evaluation of Different Bleach Sensitive Dyes | | |
|---|---|---|
| Batch | Dye (level) | Color |
| 17 | D & C Yellow 10 (0.06%) | 1-2 (yellow) |
| 18 | Acid Yellow 4 (0.06%) | 2-3 (yellow) |
| 19 | FD & C Yellow 5 (0.04%) | 1-2 (gold) |
| 20 | FD & C Yellow 6 (0.03%) | 1 (orange) |
| 21 | Acid Yellow 40 (0.04%) | 1 (yellow) |

EXAMPLE V

To evaluate the effects of different phosphorus levels and different pre-conditioning techniques, the blends outlined in Tables 9 and 10 were formulated.

TABLE 9

| 8.7% P Agglomerated Formula I | | | |
|---|---|---|---|
| Order of Addition | Component | | % in Formula |
| 1 | Sodium tripolyphosphate | | 35.00 |
| 2 | Sodium carbonate | | 30.00 |
| 3 | Nonionic surfactant: | (a) Pluronic L62D | 2.20 |
| | | (b) Pluronic L61 | 0.71 |
| | | (c) Monostearyl acid phosphate | 0.09 |
| 4 | Premix of: | (a) Water | 13.40 |
| | | (b) Colorant: Acid Yellow 17 | 0.03 |
| 5 | Sodium sulfate | | 9.62 |
| 6 | Sodium silicate (2.4 ratio $SiO_2$:$Na_2O$) | | 7.00 |
| 7 | Perfume | | 0.20 |
| 8 | Sodium dichloroisocyanurate-dihydrate | | 1.75 |

TABLE 10

| 8.7% P Agglomerated Formula II | | |
|---|---|---|
| Order of Addition | Component | % in Formula |
| 1 | Sodium tripolyphosphate | 35.00 |
| 2 | Sodium carbonate | 30.00 |
| 3 | Sodium sulfate | 7.41 |

TABLE 10-continued

| Order of Addition | Component | | % in Formula |
|---|---|---|---|
| | 8.7% P Agglomerated Formula II | | |
| 4 | Premix of: | (a) Water | 11.50 |
| | | (b) Colorant: Acid Yellow 17 | 0.04 |
| | | (c) Nonionic surfactant: | |
| | | (a) Pluronic L62D | 2.20 |
| | | (b) Pluronic L61 | 0.71 |
| | | (c) Monostearyl acid phosphate | 0.09 |
| 5 | Sodium silicate (2.58 ratio $SiO_2$:$Na_2O$) | | 11.10 |
| 6 | Perfume | | 0.20 |
| 7 | Sodium dichloroisocyanurate | | 1.75 |

Acid Yellow 17 was employed as the colorant in formulations I and II. Both employed 8.7% phosphorus level compositions. The powder with ingredients 1 through 6 in Table 9 was fluidized for 15 minutes at 65? C. Thereafter, perfume and sodium dichloroisocyanurate were post-dosed. Similarly, the ingredients 1 through 5 of Table 10 were air treated for 15 minutes at ambient temperature, and then fluidized for 10 minutes at 25? C. Subsequently, perfume and chlorinating agent were added.

Batch 23 and 24 were powders prepared according to Tables 9 and 10, respectively. Both had acceptable color. Analysis and color ratings are presented in Table 11. Batch 25 is identical to 23 except the pre-conditioning step was omitted. The % Relative Absorbance is significantly poorer for untreated 25 than 23.

TABLE 11

| Batch | Formula | Dye (level) | Color Rating | Absorbance at 410 nm | % Relative Absorbance |
|---|---|---|---|---|---|
| | | 8.7% P Agglomerated Formulas - Color Evaluation | | | |
| 23 | I | Acid Yellow 17 (0.03%) | 2 | 0.40* | 72.7 |
| 24 | II | Acid Yellow 17 (0.04%) | 1-2 | 0.56** | 86.2 |
| 25 | I | Acid Yellow 17 (0.03%) | 4 | 0.13 | 26.6 |

*Reference sample without chlorinating agent displayed 0.55 Absorbance.
**Reference sample without chlorinating agent displayed 0.65 Absorbance.

The foregoing description and examples illustrate selected embodiments of the present invention. In the light thereof, variations and modifications will be suggested to one skilled in the art, all of which are within the spirit and purview of this invention.

What is claimed is:

1. An automatic dishwasher detergent powder comprising:
   (a) from about 5% to about 70% of a builder;
   (b) from about 1% to about 15% of a nonionic surfactant;
   (c) from about 1% to about 20% of a silicate;
   (d) from about 0% to about 60% of a filler;
   (e) from about 0.001% to about 0.1% of a bleach-sensitive dye; and
   (f) water;

wherein the composition is pre-conditioned by contact with a flow of air prior to the addition of a bleaching agent, said bleach present in an effective amount to clean dishes, affording a resultant powder whose color remains essentially unchanged even after storage for two months at elevated temperature.

2. An automatic dishwasher detergent powder according to claim 1 wherein the bleaching agent is sodium or potassium dichloroisocyanurate dihydrate.

3. An automatic dishwasher detergent powder according to claim 1 wherein the nonionic surfactant is a polyoxyethylenepolyoxypropylene block copolymer.

4. An automatic dishwasher detergent powder according to claim 1, the nonionic surfactant having the formula:

$$RO-(CH_2\underset{\underset{R'}{|}}{C}HO)_x(CH_2CH_2O)_y(CH_2\underset{\underset{R''}{|}}{C}HO)_z-H$$

wherein R is a linear, alkyl hydrocarbon having an average of 6 to 10 carbon atoms, R' and R'' are each linear, alkyl hydrocarbons of about 1 to 4 carbon atoms, x is an integer from 1 to 6, y is an integer from 4 to 15 and z is an integer from 4 to 25.

5. An automatic dishwasher detergent powder according to claim 1 wherein the filler is sodium sulfate.

6. An automatic dishwasher detergent powder according to claim 1 wherein the bleach-sensitive dye has a yellow color.

7. An automatic dishwasher detergent powder according to claim 5 wherein the yellow dye is selected from the group consisting of FD&C Yellow 5, FD&C Yellow 6, FD&C Yellow 7, FD&C Yellow 8 and D&C Yellow 10 and mixtures thereof.

8. An automatic dishwasher detergent powder according to claim 5 wherein the yellow dye is selected from the group consisting of External D&C Yellow No. 7, Acid Yellow 4, Acid Yellow 17 and Acid Yellow 40 and mixtures thereof.

9. An automatic dishwasher detergent powder according to claim 1 wherein the builder is sodium tripolyphosphate.

10. An automatic dishwasher detergent powder according to claim 9 wherein sodium tripolyphosphate is present to provide a phosphorus level from about 6.1% to about 8.7%.

11. An automatic dishwasher detergent powder according to claim 1 wherein the silicate is sodium silicate.

12. An automatic dishwasher detergent powder according to claim 1 wherein the builder is sodium carbonate.

13. An automatic dishwasher detergent powder according to claim 1 wherein the builder is sodium carbonate and sodium tripolyphosphate.

14. A method for preparing an automatic dishwasher detergent powder comprising:
   (i)combining into one mixture
      (a) from about 5% to about 70% of a builder;
      (b) from about 1% to about 15% of a nonionic surfactant;
      (c) from about 1% to about 20% of a silicate;
      (d) from about 0% to about 60% of a filler;

(e) from about 0.001% to about 0.1% of a bleach-sensitive dye; and (f) water;

(ii) pre-conditioning the mixture by contact with a flow of air; and (iii) dosing the pre-conditioned mixture with a bleaching agent in an effective amount to clean dishes;

the resultant powder having a color that remains essentially unchanged even after storage for two months at elevated temperatures.

15. A method according to claim 14 wherein preconditioning is conducted in a fluidized bed.

16. A method according to claim 14 wherein air at from about 10° C. to 100° C. is used for pre-conditioning.

17. A method according to claim 16 wherein a first hotter flow of air is employed to pre-condition the composition followed by treatment with a cooler air flow.

18. A method according to claim 14 wherein the bleaching agent is sodium or potassium dichloroisocyanurate dihydrate.

19. A method according to claim 14 wherein the nonionic surfactant is a polyoxyethylene-polyoxypropylene block copolymer.

20. A method according to claim 14, the nonionic surfactant having the formula:

$$RO-(CH_2\underset{\underset{R'}{|}}{C}HO)_x(CH_2CH_2O)_y(CH_2\underset{\underset{R''}{|}}{C}HO)_z-H$$

wherein R is a linear, alkyl hydrocarbon having an average of 6 to 10 carbon atoms, R′ and R″ are each linear, alkyl hydrocarbons of about 1 to 4 carbon atoms, x is an integer from 1 to 6, y is an integer from 4 to 15 and z is an integer from 4 to 25.

21. A method according to claim 14 wherein the filler is sodium sulfate.

22. A method according to claim 14 wherein the bleach-sensitive dye has a yellow color.

23. A method according to claim 22 wherein the yellow dye is selected from the group consisting of FD&C Yellow 5, FD&C Yellow 6, FD&C Yellow 7, FD&C Yellow 8 and D&C Yellow 10 and mixtures thereof.

24. A method according to claim 22 wherein the yellow dye is selected from the group consisting of External D&C Yellow No. 7, Acid Yellow 4, Acid Yellow 17 and Acid Yellow 40 and mixtures thereof.

25. A method according to claim 14 wherein the builder is sodium tripolyphosphate.

26. A method according to claim 25 wherein sodium tripolyphosphate is present to provide a phosphorus level from about 6.1% to about 8.7%.

27. A method according to claim 14 wherein the silicate is sodium silicate.

28. A method according to claim 14 wherein the builder is sodium carbonate.

29. A method according to claim 14 wherein the builder is sodium carbonate and sodium tripolyphosphate.

30. A method according to claim 14 wherein portions of the bleach-sensitive dye are added in more than one stage to the composition but all prior to pre-conditioning.

* * * * *

UNITED STATES PATENT AND TRADEMARK OFFICE

CERTIFICATE OF CORRECTION

PATENT NO. : 4,464,281

DATED : August 7, 1984

INVENTOR(S) : Rapisarda et al.

It is certified that error appears in the above—identified patent and that said Letters Patent is hereby corrected as shown below:

Column 12, line 24: "were pre-conditioned for" should not be in bold face type.

Column 13, line 18: "65?" should read -- $65^{\circ}$ --.

Column 13, line 23: "25?" should read -- $25^{\circ}$ --.

Signed and Sealed this

*Twenty-eighth* Day of *May 1985*

[SEAL]

*Attest:*

DONALD J. QUIGG

*Attesting Officer* *Acting Commissioner of Patents and Trademarks*